US007248821B2

(12) United States Patent
Nakamura et al.

(10) Patent No.: US 7,248,821 B2
(45) Date of Patent: Jul. 24, 2007

(54) CHARGING DEVICE

(75) Inventors: Ryo Nakamura, Mishima (JP); Hiroyuki Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 303 days.

(21) Appl. No.: 11/143,218

(22) Filed: Jun. 2, 2005

(65) Prior Publication Data

US 2005/0271419 A1 Dec. 8, 2005

(30) Foreign Application Priority Data

Jun. 3, 2004 (JP) ..... 2004-165915

(51) Int. Cl.
*G03G 15/02* (2006.01)

(52) U.S. Cl. ..... 399/175; 399/115; 399/176

(58) Field of Classification Search ..... 399/107, 399/115, 130, 168, 174, 175, 176
See application file for complete search history.

(56) References Cited

U.S. PATENT DOCUMENTS

| | | | | |
|---|---|---|---|---|
| 5,809,379 | A | 9/1998 | Yano et al. | |
| 6,298,206 | B1 * | 10/2001 | Toyoshima et al. | 399/253 |
| 6,381,431 | B1 | 4/2002 | Kinoshita et al. | |
| 7,035,575 | B2 * | 4/2006 | Ikeguchi et al. | 399/267 |

* cited by examiner

*Primary Examiner*—Hoan Tran
(74) *Attorney, Agent, or Firm*—Canon U.S.A. Inc. I.P. Div.

(57) ABSTRACT

A charging device includes magnetic particles, a magnetic particle carrying member that magnetically carries the magnetic particles into contact with a member to be charged, and a magnetic particle adjusting unit for adjusting an amount per unit area of magnetic particles carried on the magnetic particle carrying member so that the amount per unit area of magnetic particles carried is larger in end regions of the magnetic particle carrying member in the longitudinal direction than in a central region of the magnetic particle carrying member in the longitudinal direction.

10 Claims, 13 Drawing Sheets

CHARGING DEVICE

BACKGROUND OF THE INVENTION

1. Field of the Invention

The present invention relates to charging devices with magnetic particles.

2. Description of the Related Art

Many image-forming apparatuses based on electrophotography or electrostatic recording have conventionally been created. The schematic structure of such an apparatus and its operation are briefly described below with reference to FIG. 2.

When a copy-start signal is input to an image-forming apparatus shown in FIG. 2, a corona charging device 3 charges the surface of a photosensitive drum 1 to a predetermined potential. In addition, an integral unit 9, which includes a document-illuminating lamp, a short-focus lens array, and a CCD sensor, illuminates and scans an original document G placed on a document table 10. The scanning light is reflected off the document surface and is focused by the short-focus lens array to enter the CCD sensor, which has a light-receiving part, a transfer part, and an output part. The light signals entering the CCD sensor are converted into charge signals in the light-receiving part. The charge signals are then synchronized with clock pulses in the transfer part, are sequentially transferred to the output part, are converted into voltage signals in the output part, are amplified with reduced impedance, and are output to the outside as analog signals. The resultant analog signals are converted into digital signals by known image processing, and are transferred to a printer section. In the printer section, an LED exposure device 2 is turned on/off in response to the above image signals to emit light which forms an electrostatic latent image corresponding to an image of the original document G on the surface of the photosensitive drum 1.

A developing device 4 containing toner particles develops the electrostatic latent image into a toner image on the photosensitive drum 1. A transfer device 7 electrostatically transfers the toner image onto a transfer material which is then electrostatically separated and carried to a fusing device 6. The toner image is thermally fused onto the transfer material to output the image.

After the toner image is transferred, a cleaner 5 removes contaminants adhering to the surface of the photosensitive drum 1, including toner residue after the transfer. In addition, if necessary, the photosensitive drum 1 is exposed to light by a pre-exposure device 8 to eliminate the optical memory of the image exposure for repeated use in image formation.

Conventionally, charging devices for use in an image-forming process with an electrophotographic image-forming apparatus as described above are typically based on corona charging, as mentioned above. In recent years, however, contact charging has been intensively researched and developed, and has already been put into practical use. Contact charging has the advantages of yielding a small amount of ozone by discharge and low power consumption.

In contact charging, a charging member is brought into contact with a photosensitive member and is supplied with voltage to charge the photosensitive member. Examples of charging devices based on this method include charging rollers and magnetic brush charging devices. Among them, a magnetic brush charging device, in which a magnetic brush serves as a contact charging member, is used to achieve contact charging stability.

A magnetic brush charging device magnetically holds conductive magnetic particles directly on the surface of a magnet or on the surface of a sleeve including the magnet. The magnetic particles are brought into contact with the surface of a photosensitive member to charge the surface of the photosensitive member.

When a magnetic brush charging device is used to charge, for example, an organic photosensitive member having a surface layer in which fine conductive particles are dispersed (according to, for example, Japanese Patent Laid-Open No. 06-003921, which corresponds to U.S. Pat. No. 5,809,379) or an amorphous-silicon-based photosensitive member, the surface of the photosensitive member can be charged to a potential substantially equivalent to the DC component of a bias applied to a magnetic brush. Such a charging method is hereinafter referred to as magnetic brush injection charging. This method involves no discharging phenomenon as used in contact charging to provide ozone-free charging with low power consumption.

Unfortunately, however, a photosensitive member of an image-forming apparatus including a magnetic brush injection charging device has a shorter life than that of an image-forming apparatus including a corona charging device. The surface of the photosensitive member wears by friction against magnetic particles after repeated use. This problem is more serious when a sleeve and the photosensitive member are rotated in opposite directions to increase the possibility of contact between the magnetic particles and the photosensitive member for higher charging stability.

The life of the photosensitive member can be significantly increased by making a modification to the photosensitive member, such as a hard protective layer provided on the surface of the photosensitive member, or a modification to the charging device, such as the coating of the magnetic particles and the reduction of the pressure between the magnetic particles and the photosensitive member for lower friction against the magnetic particles.

The pressure between the magnetic particles and the photosensitive member can be reduced by, for example, extending the distance between the sleeve and the photosensitive member or reducing the amount of magnetic particles carried on the sleeve. Such approaches, however, also have adverse effects such as insufficient contact between the magnetic particles and the photosensitive member. This results in reduced charging stability and the adhesion of the magnetic particles from the sleeve to the photosensitive member.

The most serious effect among the adverse effects is the adhesion of the magnetic particles to the photosensitive member at the outermost ends of a magnetic particle carrying region of the sleeve. Magnetic particles adhering to the photosensitive member may undesirably intrude into a developing device to degrade image quality, cause transfer defects in a transfer device, and damage the photosensitive member at a cleaner.

The adhesion of the magnetic particles to the photosensitive member at the outermost ends of the magnetic particle carrying region of the sleeve results from an unstable magnetic particle carrying state. Such an unstable state occurs probably because the magnetic force of the magnet included in the sleeve is weak at the ends of the sleeve. In addition, the contact between the magnetic particles and the photosensitive member is poorer at the outermost ends of the sleeve than the center thereof. The photosensitive member is therefore insufficiently charged at the outermost ends of the sleeve to produce a potential difference between the sleeve and the photosensitive member. This potential difference can cause the magnetic particles to adhere to the photosensitive member. Some methods, including the insulation of the ends of the sleeve, have been proposed to prevent the problem of the potential difference between the sleeve and the photosensitive member.

If, additionally, the pressure between the magnetic particles and the photosensitive member is reduced to inhibit the wear of the photosensitive member, the magnetic particle carrying state becomes unstable at the ends of the magnetic particle carrying region of the sleeve. This is more likely to result in an insufficient effect of preventing the magnetic particles carried at the ends of the sleeve from adhering to the photosensitive member.

SUMMARY OF THE INVENTION

The present invention is directed to a charging device that has a stable amount of magnetic particles carried at the ends of a magnetic particle carrying member, that can prevent the magnetic particles on the magnetic particle carrying member from adhering to a member to be charged, and that can inhibit the wear of the member to be charged.

In one aspect of the present invention, a charging device for charging a member to be charged includes magnetic particles; a magnetic particle carrying member that magnetically carries the magnetic particles into contact with the member to be charged, the magnetic particle carrying member having end regions in a longitudinal direction and a central region in the longitudinal direction; and a magnetic particle adjusting unit configured to adjust an amount per unit area of magnetic particles carried on the magnetic particle carrying member so that the amount per unit area of magnetic particles is larger in the end regions than in the central region. The end regions of the magnetic particle carrying member are regions outside of a region of the member to be charged where an electrostatic latent image is formed in the longitudinal direction. The central region of the magnetic particle carrying member is a region inside the region of the member to be charged where the electrostatic latent image is formed in the longitudinal direction.

Further features and advantages of the present invention will become apparent from the following description of exemplary embodiments with reference to the attached drawings.

DESCRIPTION OF THE EMBODIMENTS

First Embodiment

Figure 2:
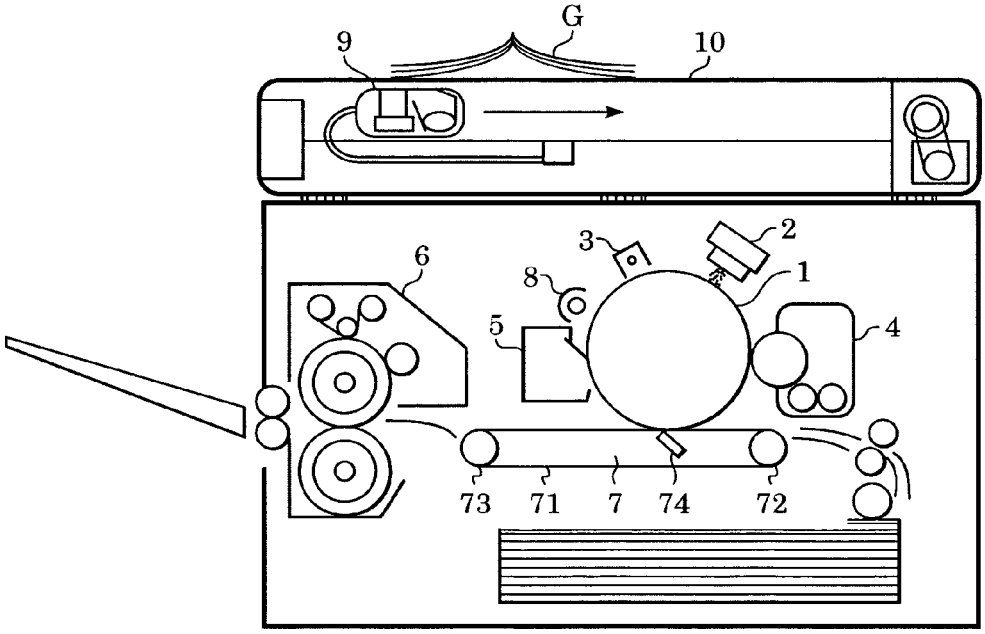
FIG. 2 PRIOR ART
FIG. 2 is a schematic diagram of an image-forming apparatus used in an example of the related art.
Figure 3:
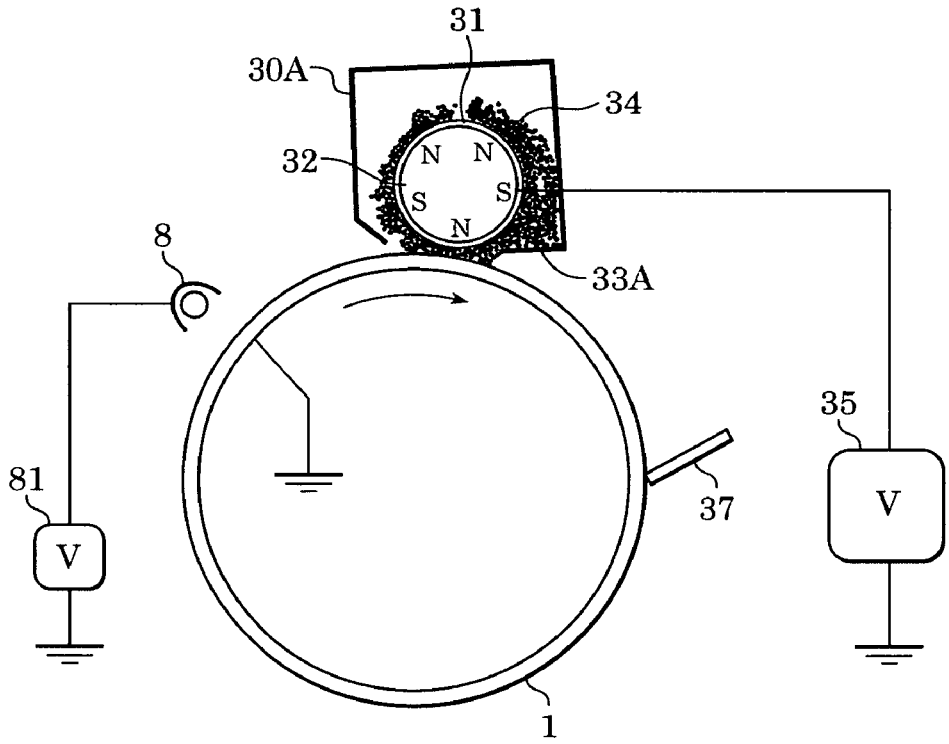
FIG. 3 is a schematic diagram of an image-forming apparatus used in the first embodiment of the present invention.

FIG. 3 is a schematic diagram of an image-forming apparatus used in a first embodiment. In this embodiment, a magnetic brush charging device 30A shown in FIG. 3 is used instead of the corona charging device 3 used in the example of the related art in FIG. 2. This charging device 30A magnetically holds charging magnetic particles 34 and brings them into contact with a member to be charged, namely a photosensitive member 1, to charge the photosensitive member 1. The photosensitive member 1 used is a positively charged amorphous-silicon-based (a-Si-based) photosensitive member.

Figure 23:
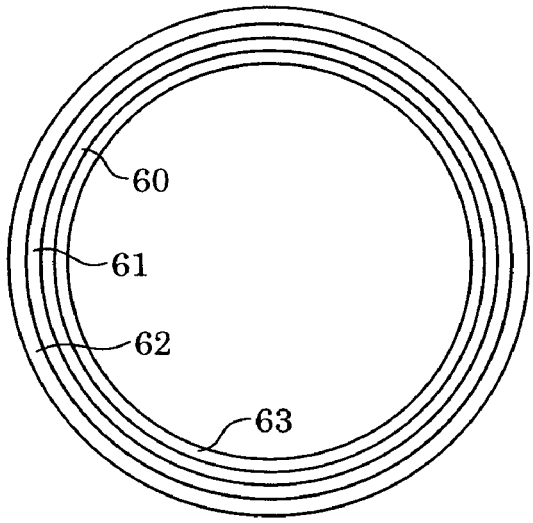
FIG. 23 is a schematic diagram of a photosensitive member used in the first and second embodiments.

Referring to FIG. 23, the positively charged a-Si-based photosensitive member 1 used in this embodiment is a photosensitive drum including a conductive support 63 that is made of aluminum (Al) and has a diameter of about 80 mm, a negative charge blocking layer 60, a photoconductive layer 61, and a surface protective layer 62. These layers 60, 61, and 62 are sequentially laminated on the conductive support 63.

A magnetic brush charging device is described below. Conductive magnetic particles are magnetically held directly on a magnet or on a sleeve including the magnet. The magnet or the sleeve is fixed or rotatable with respect to a photosensitive member. The magnetic particles are brought into contact with the photosensitive member, which is supplied with a voltage through the magnetic particles, so as to start a charging process.

The magnetic brush charging device 30A used in this embodiment has a rotatable, nonmagnetic charging sleeve (magnetic particle carrying member) 31 containing a fixed magnet 32. The magnetic particles 34 are carried on the charging sleeve 31 in a brush form by a magnetic field. The magnetic particles 34 are controlled by a magnetic particle control member 33A, and are carried as the charging sleeve 31 rotates.

The charging sleeve 31 rotates in the direction opposite to the rotational direction of the photosensitive member 1 in the area between the charging sleeve 31 and the photosensitive member 1. The charging sleeve 31 is supplied with the charging voltage to charge the photosensitive member 1 through the magnetic particles 34 to nearly the potential corresponding to the charging voltage. The charging sleeve 31 may be rotated in the direction opposite to the rotational direction of the photosensitive member 1 in the area between the charging sleeve 31 and the photosensitive member 1 to improve injection charging properties.

The magnetic particles 34 used may have an average particle size of 10 to 100 μm, a saturation magnetization of 20 to 250 emu/cm$^3$, and a resistance of $10^2$ to $10^{10}$ Ω·cm. Although the lowest resistance possible offers better charging properties, the resistance may be $10^6$ Ω·cm or more in consideration of insulation defects of the photosensitive member 1, such as pin holes. In this embodiment, the resistance of the magnetic particles 34 is adjusted by oxidation and reduction of the ferrite surfaces, and the magnetic particles 34 are then subjected to coupling. The magnetic particles 34 used for charging in this embodiment have an average particle size of about 25 μm, a saturation magnetization of about 200 emu/cm$^3$, and a resistance of about $5\times10^6$ Ω·cm.

The resistance of the magnetic particles 34 used in this embodiment is measured by placing 2 g of the magnetic particles 34 into a metal cell having a bottom area of 228 cm$^2$, applying a load of 6.6 kg/cm$^2$, and applying a voltage of 100 V.

In this embodiment, a test described below is carried out to determine the amount of wear of the photosensitive drum 1 and the amount of magnetic particles adhering to the photosensitive member 1 at the ends of the charging sleeve 31 relative to the amount of magnetic particles carried on the charging sleeve 31.

Figure 9:
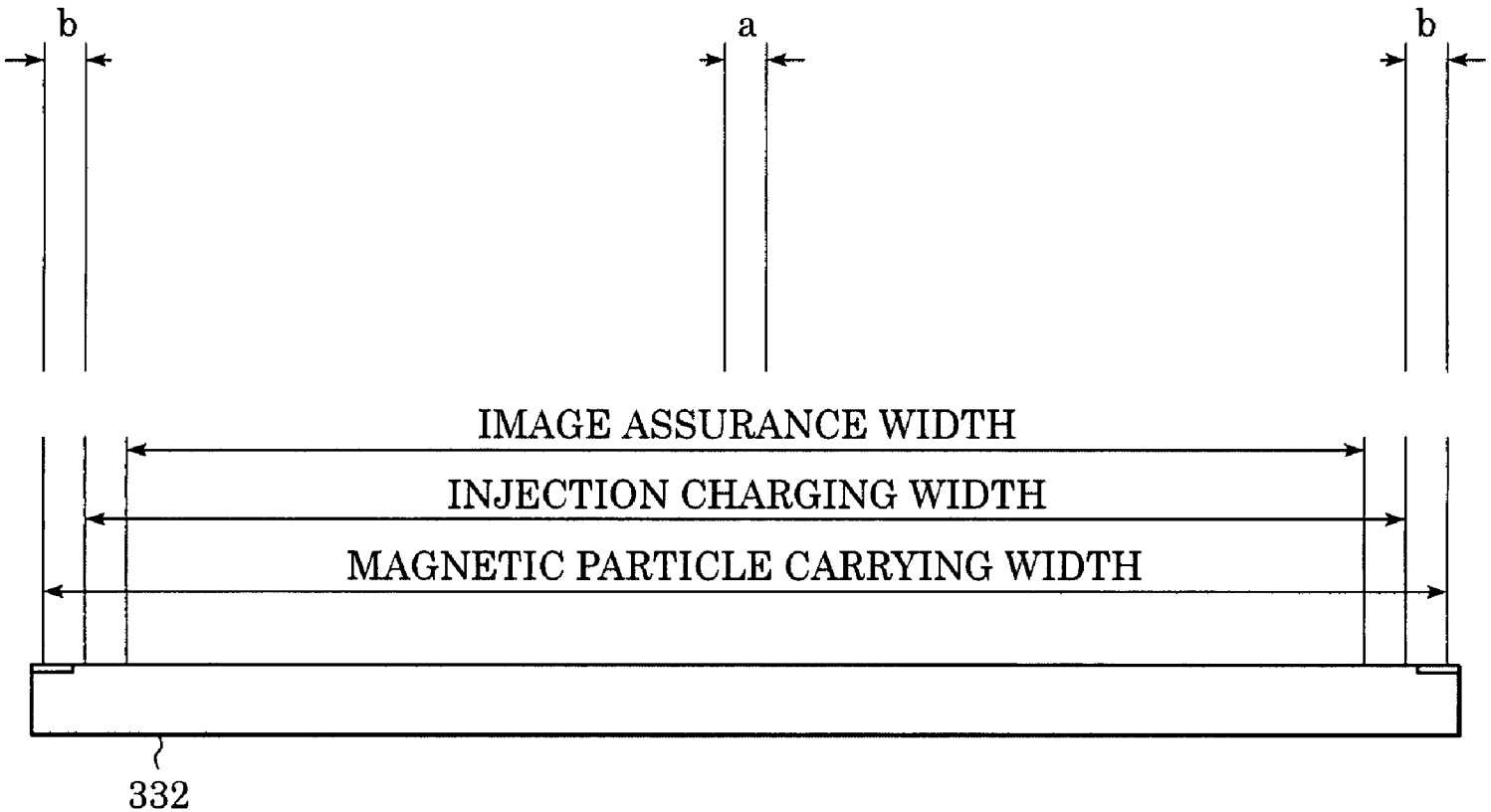
FIG. 9 shows the relationship between longitudinal widths in an image-forming apparatus used in the present invention.

In this embodiment, an image assurance width refers to the longitudinal width of the region of the charging sleeve 31 corresponding to a region of the photosensitive member 1 in which an image is formed (a region in which a toner image is formed by a developing device). A magnetic particle carrying width refers to the width of a region of the charging sleeve 31 in which the magnetic particles 34 are carried by magnetic force. In this embodiment, the magnetic particle carrying width equals to the width of the magnet 32 in the charging sleeve 31. The ends of the charging sleeve 31 are insulated by resin coating to eliminate potential differences at the ends of the charging sleeve 31. An injection charging width refers to the width of the uninsulated region of the charging sleeve 31, in which the magnetic particles 34 are brought into contact with the photosensitive member 1 to perform injection charging. The injection charging width is adjusted to a width larger than the image assurance width and smaller than the magnetic particle carrying width. The resin coating has a thickness of about 50 μm. The relationship between the above widths in the longitudinal direction is shown in FIG. 9, in which the region of the image assurance width is referred to as a central region and the regions outside the image assurance width are referred to as end regions.

Figure 1:
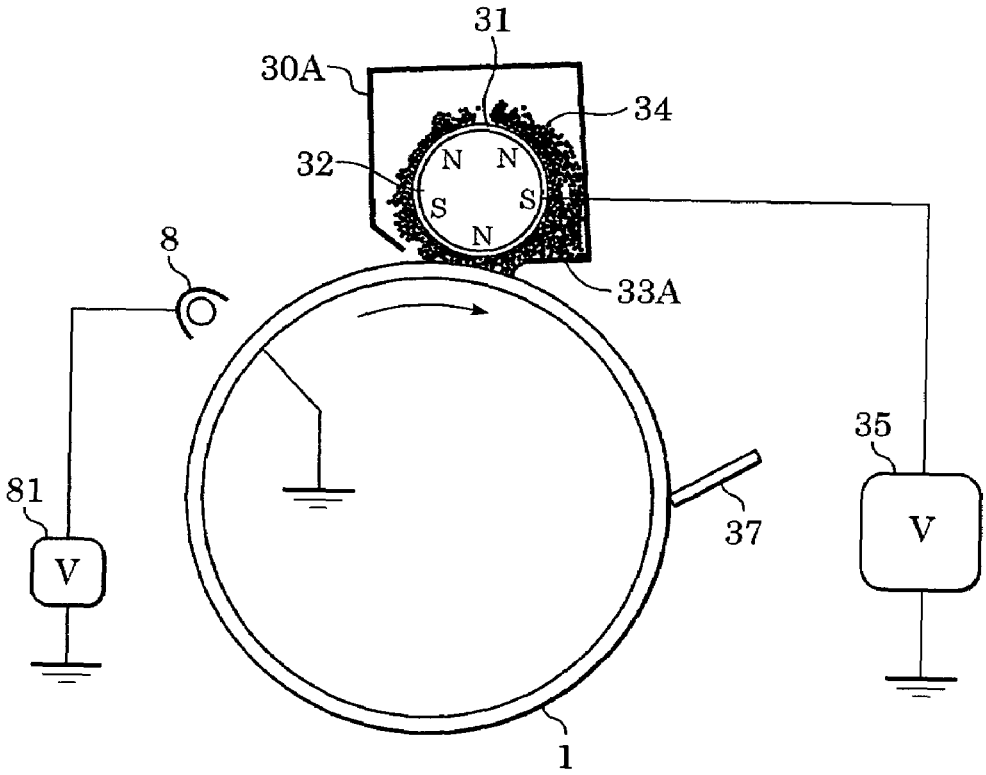
FIG. 1 is a schematic diagram of a photosensitive member used in a first embodiment of the present invention and the vicinity thereof.

In this embodiment, as shown in FIG. 3, the photosensitive member 1 is provided only with the magnetic brush charging device 30A and a pre-exposure lamp 8; other components are omitted to determine the net amount of wear due to friction against the charging device 30A. FIG. 1 is a schematic diagram of the photosensitive member 1 and its vicinity. A plastic magnet 37 is aimed at magnetically collecting magnetic particles adhering from the charging sleeve to the photosensitive member 1, as will be described below.

The above arrangement poses no serious problem in the test because magnetic particles adhering to the photosensitive member 1 within the image assurance width are recovered by the charging sleeve 31.

The pre-exposure lamp 8 used is an LED with a wavelength of about 660 nm. The pre-exposure lamp 8 is supplied with a voltage of 20 V from a pre-exposure power supply 81 to expose the photosensitive member 1 to light at about 370 lux-sec.

The photosensitive member 1 has a diameter of 80 mm and a rotational speed of 400 mm/sec. The charging sleeve 31 has a diameter of 16 mm and a rotational speed of 180 mm/sec, and the surface thereof is processed by blasting with alundum (180 mesh). A charging container contains 100 g of the magnetic particles 34. In charging, a charging bias device 35 supplies the charging sleeve 31 with a charging bias with a DC voltage of 600 V, an AC voltage of 300 Vpp, and a frequency of 1 kHz.

Figure 22:
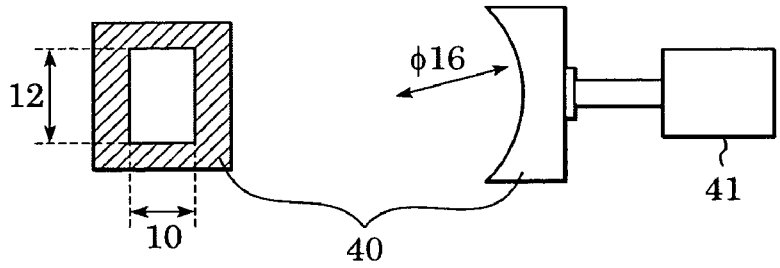
FIG. 22 is a schematic diagram of a jig for recovering magnetic particles.

The amount of magnetic particles carried on the charging sleeve 31 at the nip between the photosensitive member 1 and the charging sleeve 31 is measured with a measurement jig 40 (shown in FIG. 22) provided with a window with a length of 12 mm and a width of 10 mm and having a radius of curvature of 16 mm. After the magnetic brush charging device 30A is provided to the photosensitive member 1, they are rotated at the above predetermined rotational speeds for five seconds, and are stopped to measure the amount of magnetic particles carried. The measurement jig 40 is allowed to butt against the charging sleeve 31 to suck the magnetic particles 34 in the window of the measurement jig 40 with a suction unit 41. The amount of magnetic particles sucked is divided by the area of the window of the measurement jig 40 to determine the amount of magnetic particles carried. The measurement was performed at a central part (a region a in FIG. 9) of the image assurance region of the charging sleeve 31, as the central region of the charging sleeve 31, and at end parts (regions b in FIG. 9) of the magnetic particle carrying region outside the image assurance region, as the end regions of the charging sleeve 31.

The amount of wear of the photosensitive member 1 is determined by measuring the thickness of the surface layer thereof before and after a durability test and then calculating the difference. The thickness of the surface layer is measured with an interference thickness gauge at a total of 20 spots (all in the image assurance region), namely 5 spots at intervals of 4 cm from the center to the ends of the photosensitive member 1 in the longitudinal direction by 4 spots in the circumferential direction of the photosensitive member 1. The measured values are averaged to determine the thickness of the surface layer of the photosensitive member 1.

As described above, the magnetic particles 34 adhere to the photosensitive member 1 mainly at the ends of the charging sleeve 31, and few magnetic particles 34 adhere to the photosensitive member 1 in the center of the charging sleeve 31. Accordingly, the amount of magnetic particles adhering to the photosensitive member 1 at the ends of the charging sleeve 31 may be measured to determine whether the adhesion of the magnetic particles 34 is acceptable for the photosensitive member 1. As shown in FIG. 3, the plastic magnet 37 is allowed to butt against the ends of a development position of the photosensitive member 1 to magnetically collect the magnetic particles 34 adhering from the charging sleeve 31 to the photosensitive member 1. The magnetic particles 34 collected by the plastic magnet 37 are recovered with a suction unit, and the mass thereof is measured with an electronic balance to determine the amount of magnetic particles adhering to the photosensitive member 1 at the ends of the charging sleeve 31. The ends of the development position of the photosensitive member 1 refer to the regions corresponding to the end regions (the regions b in FIG. 9) of the charging sleeve 31.

COMPARATIVE EXAMPLE 1-1

Figure 4:
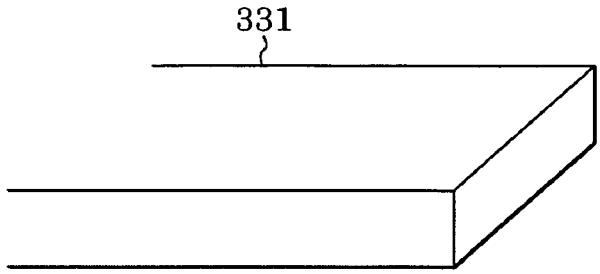
FIG. 4 is a schematic diagram of a control blade used in Comparative Example 1-1.

Comparative Example 1-1 is described below as a specific comparative example for the first embodiment. In this example, the magnetic particle control member 33A used was a nonmagnetic plate (control blade) 331 shown in FIG. 4.

The distance between the control blade 331 and the charging sleeve 31 was adjusted so that the amount of magnetic particles carried in the central region of the charging sleeve 31 in the longitudinal direction was about 50, 100, 150, and 200 mg/cm$^2$. The distance between the charging sleeve 31 and the photosensitive member 1 was adjusted to about 300, 400, 500, 600, and 700 μm. For each combination of the above conditions, an idling durability test equivalent to 10,000 copies of A4 sheets was carried out to measure the amount of wear of the photosensitive member 1 and the amount of magnetic particles adhering to the photosensitive member 1 at the ends of the charging sleeve 31.

Figure 5:
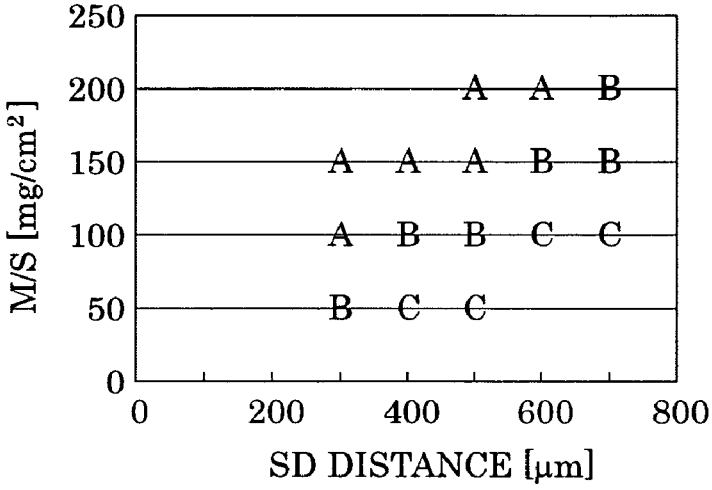
FIG. 5 is a first graph showing the results of Comparative Example 1-1.
Figure 6:
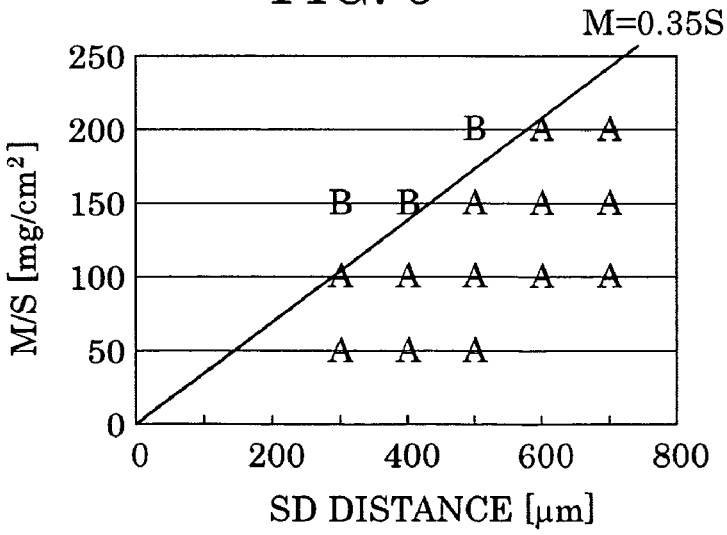
FIG. 6 is a second graph showing the results of Comparative Example 1-1.

FIGS. 5 and 6 show the results of the above test. In FIGS. 5 and 6, the vertical axis represents the amount of magnetic particles carried in the central region (image assurance region) of the charging sleeve 31, and the horizontal axis represents the distance between the charging sleeve 31 and the photosensitive drum 1 (SD distance). In FIG. 5, the symbols A, B, and C mean that the amounts of magnetic particles adhering to the photosensitive member 1 at the ends of the charging sleeve 31 were less than 1 g, 1 g to less than 3 g, and 3 g or more, respectively. In FIG. 6, the symbols A, B, and C mean that the amounts of wear of the photosensitive member 1 were less than 10 Å, 10 Å to less than 20 Å, and 20 Å or more, respectively. For both amounts, the symbol A is determined to be at an acceptable level for practical use.

According to the test results, a longer distance between the charging sleeve 31 and the photosensitive member 1 or a smaller amount of magnetic particles carried on the charging sleeve 31 results in a smaller amount of wear of the photosensitive member 1, but also results in a larger amount of magnetic particles adhering to the photosensitive member 1 at the ends of the charging sleeve 31.

Figure 21:
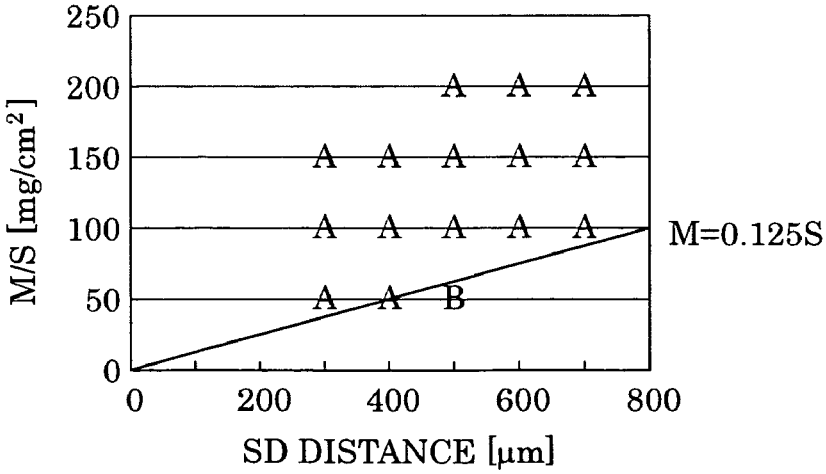
FIG. 21 is a graph showing the results of measurements of potentials in Comparative Example 1-1.

Next, the potential at the development position was measured for each condition using an electrostatic voltmeter (Model 344, manufactured by Trek, Inc.). FIG. 21 shows the measurement results. In FIG. 21, the symbol A means that periodic variations resulting from the photosensitive drum 1 were excellently reproduced, and the symbol B means that other non-periodic variations occurred.

According to the above results, a longer distance between the charging sleeve 31 and the photosensitive member 1 or a smaller amount of magnetic particles carried on the charging sleeve 31 results in a smaller amount of wear of the photosensitive member 1, but also results in a larger amount of magnetic particles adhering to the photosensitive member 1 at the ends of the charging sleeve 31 and lower charging properties of the charging device 30A.

Accordingly, the amount per unit area of magnetic particles carried in the central region of the charging sleeve 31 in the longitudinal direction, namely M (mg/cm$^2$), and the distance between the charging sleeve 31 and the photosensitive member 1 in the central region of the charging sleeve 31 in the longitudinal direction, namely S (μm), may be controlled such that $M<0.35S$ in view of the amount of wear of the photosensitive drum 1 and $M \geqq 0.125S$ in view of the maintenance of the charging properties. Hence, a reduction in the amount of magnetic particles adhering to the photosensitive member 1 at the ends of the charging sleeve 31 is desired within the above range.

EXAMPLE 1-1

Figure 7:
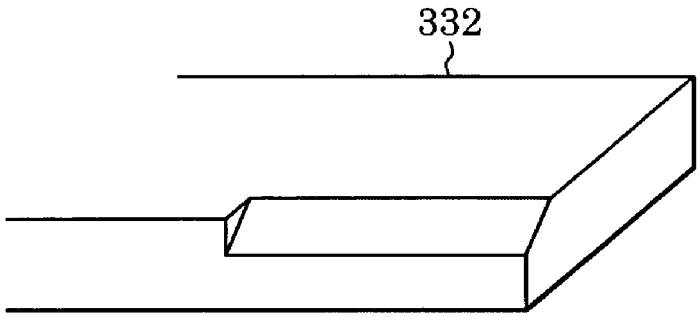
FIG. 7 is a first schematic diagram of a control blade used in Example 1-1.
Figure 8:
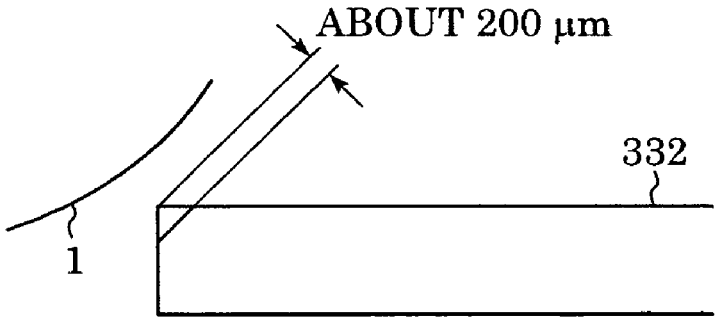
FIG. 8 is a second schematic diagram of the control blade used in Example 1-1.

Example 1-1 is described below as a specific example of the first embodiment. Instead of the plate 331 used in Comparative Example 1-1, a control blade 332 was used as the magnetic particle control member (magnetic particle adjusting unit) 33A to increase the amount of magnetic particles carried at the ends of the magnetic particle carrying region of the charging sleeve 31. FIGS. 7, 8, and 9 are schematic diagrams of the control blade 332, which had cut portions with a depth of about 200 μm in its end control regions outside the injection charging width in the longitudinal direction.

The above control blade 332 was confirmed to provide a larger amount of magnetic particles carried at the ends of the magnetic particle carrying region of the charging sleeve 31 in the longitudinal direction than the amount of magnetic particles carried in the center by about 40 mg/cm$^2$. In addition, the above control blade 332 was visually confirmed to allow the stabilization of the magnetic particle carrying state as well as the increase in the amount of magnetic particles carried at the ends of the magnetic particle carrying region of the charging sleeve 31. Such a larger amount of magnetic particles carried had greater opportunity for contact with each other. This made it difficult for the photosensitive member 1 to remove the magnetic particles 34 from the charging sleeve 31 when the magnetic particles 34 were brought into contact with the photosensitive member 1, thus inhibiting carrier adhesion.

The same test as in Comparative Example 1-1 was carried out using the above control blade 332. The test results are shown in FIGS. 10 and 11, in which the axes and the evaluation methods are the same as those in FIGS. 5 and 6.

Figure 10:
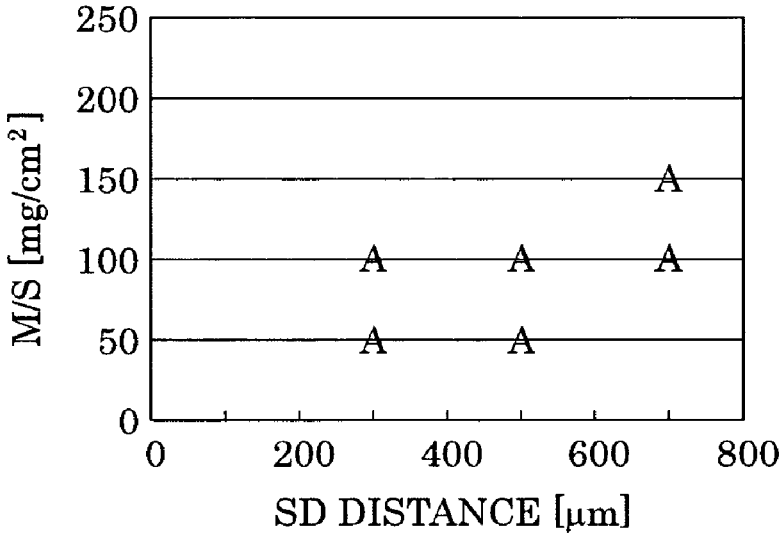
FIG. 10 is a first graph showing the results of Example 1-1.
Figure 11:
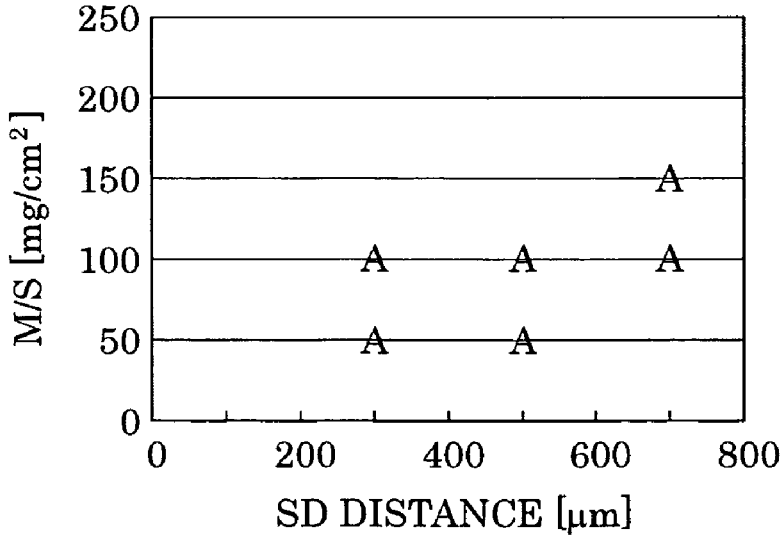
FIG. 11 is a second graph showing the results of Example 1-1.

The results in FIG. 10 show that the amount of magnetic particles adhering to the photosensitive member 1 at the ends of the charging sleeve 31 may be inhibited by increasing only the amount per unit area of magnetic particles carried in the end regions of the charging sleeve 31 relative to that of magnetic particles carried in the central region. Referring to FIG. 11, additionally, the amount of wear of the photosensitive drum 1 did not increase because the amount of magnetic particles carried was not increased in the image assurance region of the charging sleeve 31. This enables long-term stable operation.

In this case, the amount of wear of the photosensitive drum 1 may increase at the ends of the charging sleeve 31.

This increase, however, is negligible for practical use if the amount of magnetic particles carried is increased outside the image assurance region in the longitudinal direction.

As described in Comparative Example 1-1, the conditions of the charging sleeve 31 may be controlled such that $M<0.35S$ in view of the amount of wear of the photosensitive drum 1 and $M \geqq 0.125S$ in view of the maintenance of the charging properties.

Second Embodiment

Figure 12:
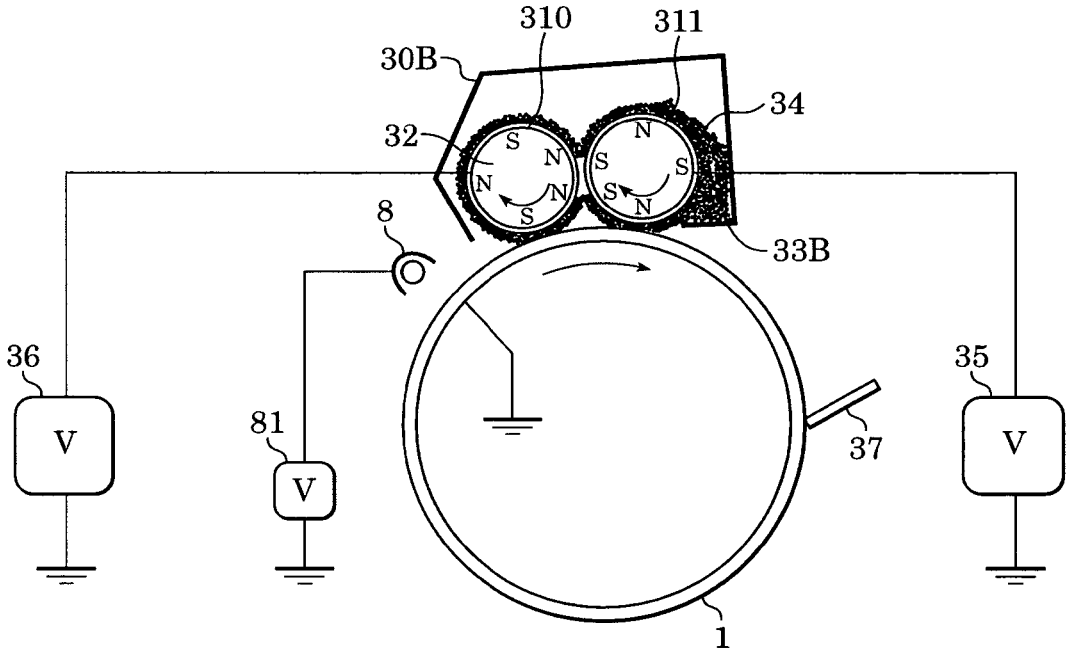
FIG. 12 is a schematic diagram of an image-forming apparatus used in a second embodiment of the present invention.

An image-forming apparatus used in a second embodiment has substantially the same structure as that used in the first embodiment except for a magnetic brush charging device 30B. FIG. 12 is a schematic diagram of the image-forming apparatus used in the second embodiment.

In FIG. 12, the magnetic brush charging device 30B used in this embodiment includes two charging sleeves for double charging in each image-forming cycle. An advantage of double charging is described below.

An a-Si-based photosensitive member is produced by converting gas into plasma with high frequencies or microwaves and solidifying and depositing it on an aluminum cylinder. This type of photosensitive member therefore has the problem that nonuniform plasma causes variations in thickness and composition in the circumferential direction.

An a-Si-based photosensitive member exhibits a significantly larger amount of potential decay in a dark state after charging than an organic photosensitive member. In addition, the amount of potential decay increases by optical memory in image exposure. Thus, a pre-exposure device is required to erase the optical memory in a previous cycle. Accordingly, the amount of potential decay between charging and development is extremely large, namely about 100 to 200 V. In such a state, the variations in thickness described above result in potential variations of about 10 to 20 V in the circumferential direction.

An a-Si-based photosensitive member is more susceptible to such potential variations than an organic photosensitive member because an a-Si-based photosensitive member has a higher electrostatic capacity and lower contrast than an organic photosensitive member, thus exhibiting more significant variations in density.

For example, multiple charging of the photosensitive member is effective against the above problem. The increase in dark decay due to optical memory described above can be reduced by multiple charging in which first charging greatly reduces the optical memory to provide a smaller amount of dark decay after second charging. Multiple charging can therefore greatly reduce potential ghosts and potential variations.

The effect described above is the advantage of the double charging.

The magnetic brush charging device 30B used in this embodiment has a first charging sleeve 310 and a second charging sleeve 311 that are rotatable and nonmagnetic and each contain a fixed magnet 32. Charging magnetic particles 34 are held on the charging sleeves 310 and 311 in a brush form by a magnetic field. The magnetic particles 34 are controlled by a magnetic particle control member 33B, and are carried as the charging sleeves 310 and 311 rotate.

The magnetic particles 34 are kept away from the vicinity of adjacent repelling poles, which are the same pole, of the charging sleeves 310 and 311. In this embodiment, the adjacent repelling poles are positioned so that the magnetic particles 34 move around the charging sleeves 310 and 311 rather than enter the space between the charging sleeves 310 and 311.

The charging sleeves 310 and 311 rotate in the direction opposite to the rotational direction of the photosensitive member 1 in the area between the charging sleeves 310 and 311 and the photosensitive member 1. The charging sleeves 310 and 311 are supplied with charging voltage to charge the photosensitive member 1 through the magnetic particles 34 to nearly the potential corresponding to the charging voltage.

The photosensitive member 1 has a diameter of 80 mm and a rotational speed of 400 mm/sec. The first and second charging sleeves 310 and 311 have a diameter of 16 mm and a rotational speed of 180 mm/sec, and the surfaces thereof are processed by blasting with alundum (180 mesh). A charging container contains 100 g of the magnetic particles 34. In charging, a charging bias device 36 supplies the first charging sleeve 310 with a charging bias with a DC voltage of 600 V, an AC voltage of 300 Vpp, and a frequency of 1 kHz while another charging bias device 35 supplies the second charging sleeve 311 with a charging bias with a DC voltage of 500 V, an AC voltage of 300 Vpp, and a frequency of 1 kHz.

As in the first embodiment, additionally, the ends of the first and second charging sleeves 310 and 311 are insulated by resin coating so that the width of the uninsulated region is larger than the image assurance width and is smaller than the magnetic particle carrying width. The resin coating has a thickness of about 50 μm.

COMPARATIVE EXAMPLE 2-1

Comparative Example 2-1 is described below as a specific comparative example for the second embodiment. In this example, as in Comparative Example 1-1, the magnetic particle control member 33B used was the nonmagnetic plate (control blade) 331 shown in FIG. 4.

The distance between the control blade 331 and the charging sleeve 31 was adjusted so that the amount of magnetic particles carried in the central region of the charging sleeve 31 in the longitudinal direction was about 50, 100, and 150 mg/cm$^2$. The distances between the charging sleeves 310 and 311 and the photosensitive member 1 were adjusted to about 300 and 500 μm. For each combination of the above conditions, an idling durability test equivalent to 10,000 copies of A4 sheets was carried out to measure the amount of wear of the photosensitive member 1 and the amount of magnetic particles adhering to the photosensitive member 1 at the ends of the charging sleeves 310 and 311.

The amount of wear of the photosensitive member 1 and the amount of magnetic particles adhering to the photosensitive member 1 at the ends of the charging sleeves 310 and 311 were measured by the same methods as in Comparative Example 1-1.

Figure 13:
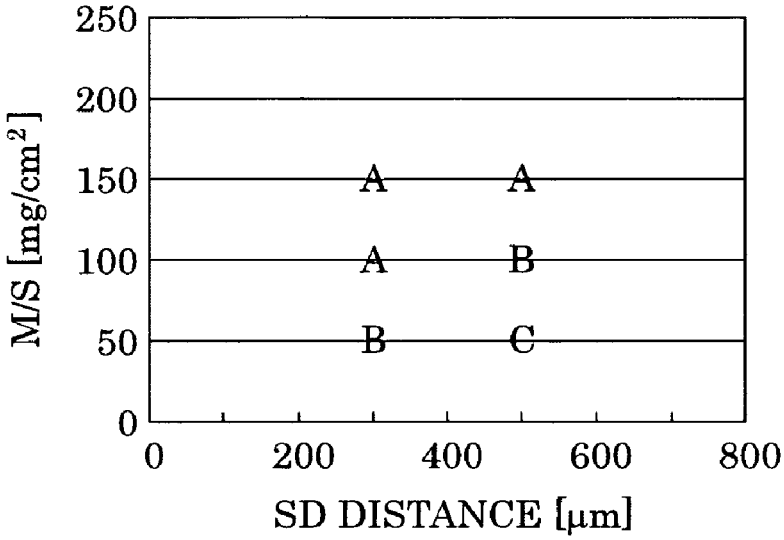
FIG. 13 is a first graph showing the results of Comparative Example 2-1.
Figure 14:
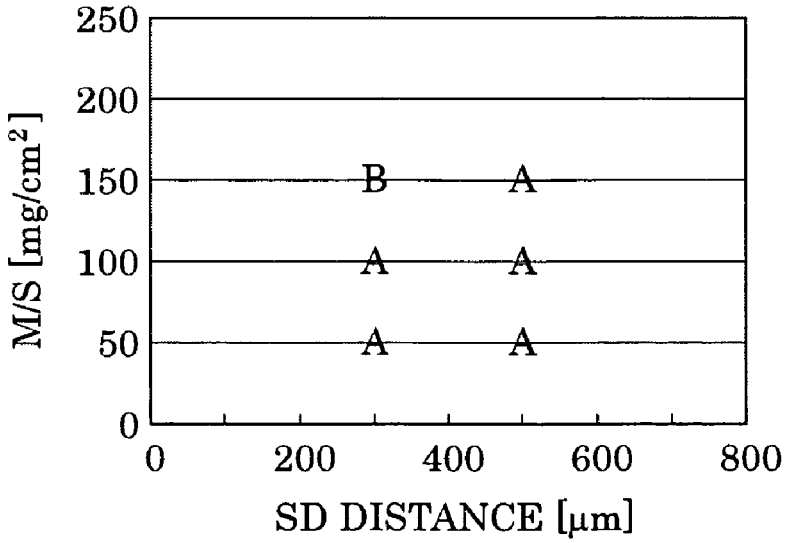
FIG. 14 is a second graph showing the results of Comparative Example 2-1.

FIGS. 13 and 14 show the results of the above test. In FIG. 13, the symbols A, B, and C mean that the amounts of magnetic particles adhering to the photosensitive member 1 at the ends of the charging sleeves 310 and 311 were less than 1 g, 1 g to less than 3 g, and 3 g or more, respectively. In FIG. 14, the symbols A, B, and C mean that the amounts of wear of the photosensitive member 1 were less than 10 Å, 10 Å to less than 20 Å, and 20 Å or more, respectively.

According to the test results, longer distances between the charging sleeves 310 and 311 and the photosensitive member 1 or a smaller amount of magnetic particles carried on the charging sleeves 310 and 311 results in a smaller amount of wear of the photosensitive member 1, but also results in a larger amount of magnetic particles adhering to the photosensitive member 1 at the ends of the charging sleeves 310 and 311.

Two charging sleeves were used in this example, though the amount of wear was similar to that for a single charging sleeve. The second charging sleeve 311 is positioned upstream in the movement direction of the magnetic particles 34 in the area (nips) between the charging sleeve 310 and 311 and the photosensitive member 1. The second charging sleeve 311 has a great effect on the amount of wear, while the first charging sleeve 310 has no significant effect on the amount of wear. The pressure between the first charging sleeve 310 and the photosensitive member 1 is lower than that between the second charging sleeve 311 and the photosensitive member 1 because only magnetic particles passing through the nip between the second charging sleeve 311 and the photosensitive member 1 pass through the nip between the first charging sleeve 310 and the photosensitive member 1.

In addition, the amount of magnetic particles carried on the second charging sleeve 311 has a great effect on the amount of magnetic particles adhering to the photosensitive member 1 at the ends of the charging sleeves 310 and 311. The second charging sleeve 311 is positioned downstream in the rotational direction of the photosensitive member 1 to recover magnetic particles detached from the first charging sleeve 310, which is positioned upstream in the rotational direction of the photosensitive member 1. The upstream and downstream sides in the rotational direction of the photosensitive member 1 are defined with respect to the position of a developing device; the downstream side is defined as the side near the developing device.

EXAMPLE 2-1

Figure 15:
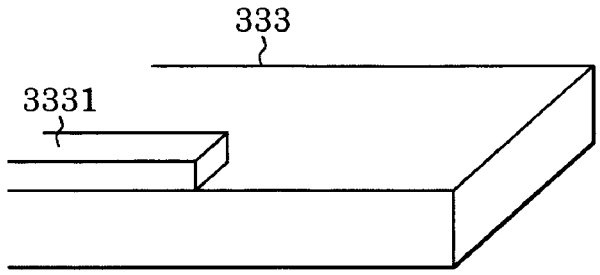
FIG. 15 is a schematic diagram of a control blade used in Example 2-1.

Example 2-1 is described below as a specific example of the second embodiment. FIG. 15 is a schematic diagram of a control blade 333 used to increase the amount of magnetic particles carried at the ends of the magnetic particle carrying region of the charging sleeve 31. This control blade 333 included a plate as used in Comparative Example 2-1 and a nonmagnetic plate 3331 bonded in the vicinity of the magnetic particle control region of the above plate. The nonmagnetic plate 3331 had a width larger than the injection charging width and smaller than the magnetic particle carrying width in the longitudinal direction, and has a thickness of about 280 μm.

Figure 16:
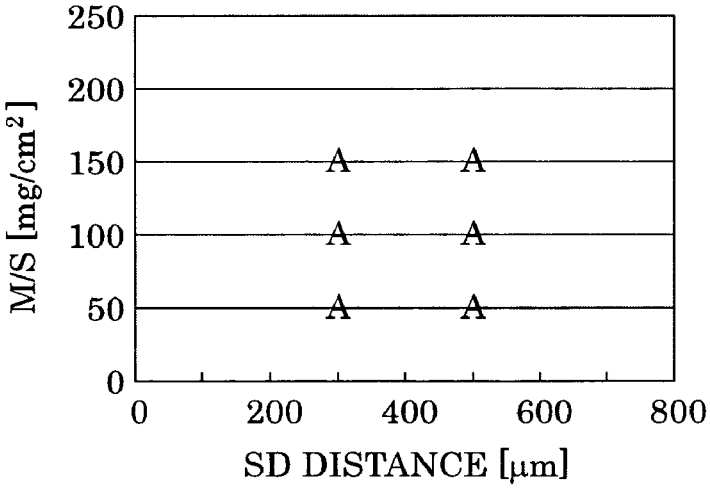
FIG. 16 is a first graph showing the results of Example 2-1.
Figure 17:
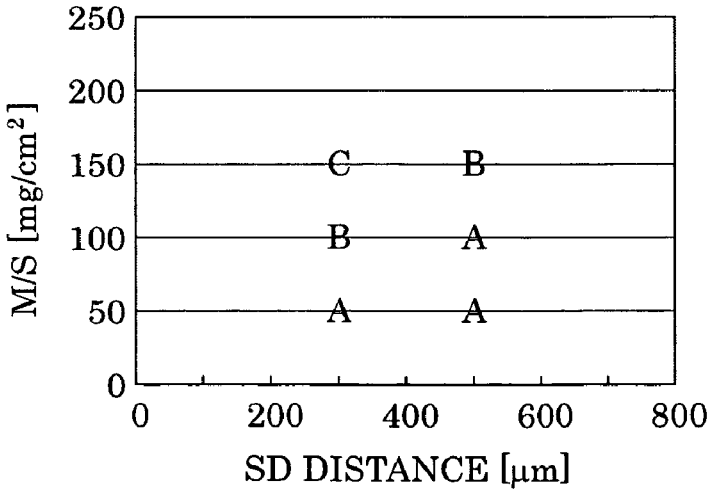
FIG. 17 is a second graph showing the results of Example 2-1.

The above control blade 333 was visually confirmed to increase the amount of magnetic particles carried at the ends of the magnetic particle carrying region of the charging sleeves 310 and 311 and stabilize the magnetic particle carrying state. Subsequently, the same test as in Comparative Example 2-1 was carried out. FIGS. 16 and 17 show the test results.

As in the case of Example 1-1, the test results show that the amount of magnetic particles adhering to the photosensitive member 1 at the ends of the charging sleeves 310 and 311 may be inhibited with no increase in the amount of wear of the photosensitive drum 1 by increasing only the amount per unit area of magnetic particles carried in the end regions of the charging sleeves 310 and 311 relative to that of magnetic particles carried in the central regions.

In this example, as in Comparative Example 2-1, the second charging sleeve 311 has a great effect on the amount of wear. As described in Comparative Example 1-1, additionally, at least the conditions of the second charging sleeve 311 may be controlled such that $M<0.35S$ in view of the amount of wear of the photosensitive drum 1 and $M \geqq 0.125S$ in view of the maintenance of the charging properties. Within the above range, the second charging sleeve 311 provides a satisfactorily small amount of wear of the photosensitive drum 1 and excellent charging properties.

In this case, the amount of wear of the photosensitive drum 1 may increase at the ends of the charging sleeves 310 and 311. This increase, however, is negligible for practical use if the amount of magnetic particles carried is increased outside the image assurance region in the longitudinal direction.

Third Embodiment

Figure 18:
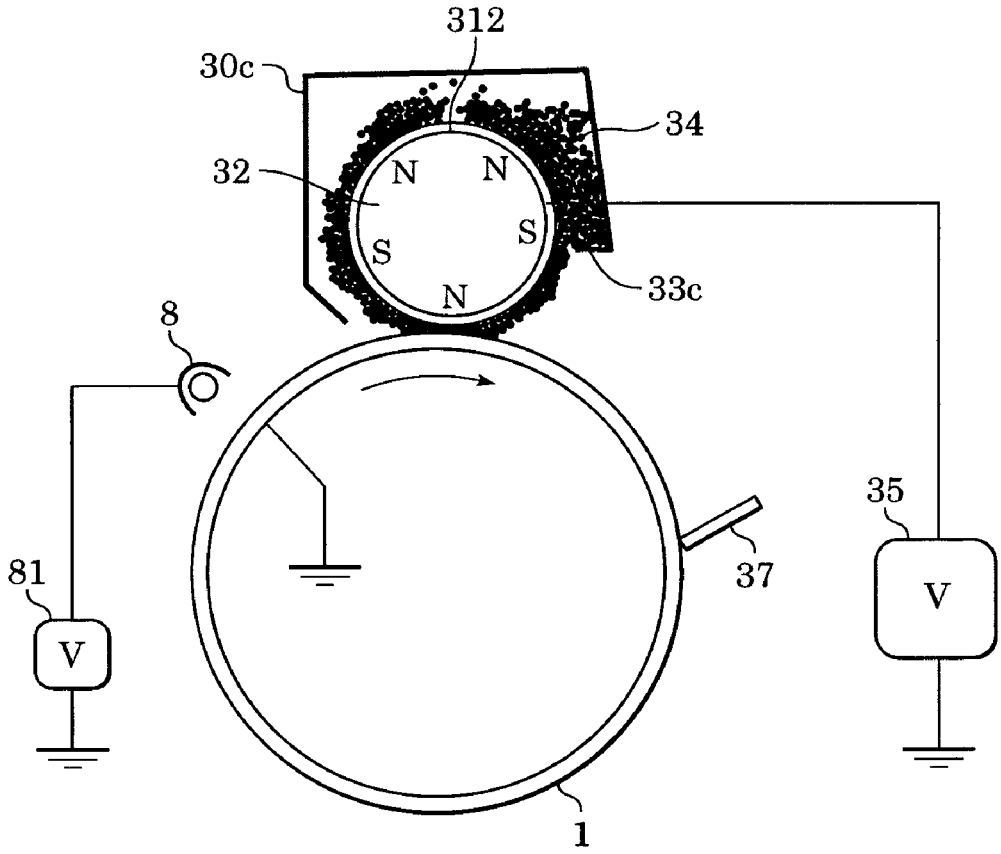
FIG. 18 is a schematic diagram of an image-forming apparatus used in a third embodiment of the present invention.

An image-forming apparatus used in a third embodiment has substantially the same structure as that used in the first embodiment except that a positively charged organic photosensitive member is used as the photosensitive member 1 instead of an a-Si-based photosensitive member. FIG. 18 is a schematic diagram of the image-forming apparatus used in the third embodiment.

Figure 24:
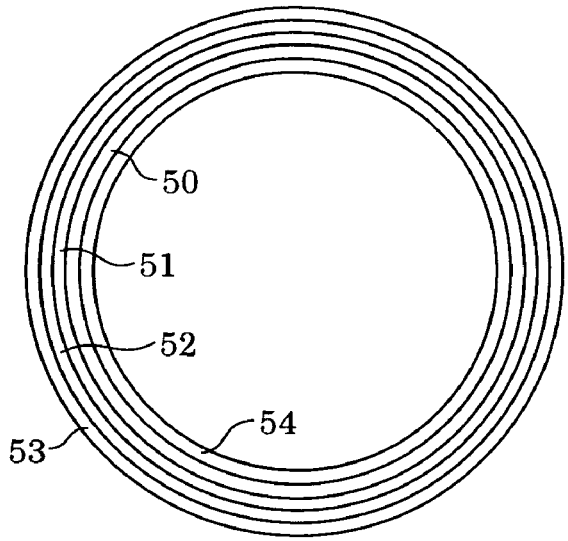
FIG. 24 is a schematic diagram of a photosensitive member used in the third embodiment.

Referring to FIG. 24, the organic photosensitive member 1 used in this embodiment includes a conductive support 54 that is made of Al and has a diameter of 80 mm, a positive charge blocking layer 50, a charge generation layer 51, a charge transport layer 52, and an electron injection layer 53. The positive charge blocking layer 50, the charge generation layer 51, and the charge transport layer 52 are sequentially laminated on the conductive support 54, and the electron injection layer 53 is disposed on the photosensitive layers.

The photosensitive member 1 has a diameter of 80 mm and a rotational speed of 400 mm/sec. A charging sleeve 312 has a diameter of 24 mm and a rotational speed of 180 mm/sec, and the surface thereof is processed by blasting with alundum (180 mesh). The distance between the charging sleeve 312 and the photosensitive member 1 is adjusted to about 300 μm. A charging container contains 100 g of magnetic particles 34. The distance between a control blade 33C and the charging sleeve 312 is adjusted so that the amount of magnetic particles carried in the central region of the charging sleeve 312 in the longitudinal direction is about 50 mg/cm$^2$. In charging, a charging bias device 35 supplies the charging sleeve 312 with a charging bias with a DC voltage of 600 V, an AC voltage of 300 Vpp, and a frequency of 1 kHz.

A charging sleeve having a larger diameter provides a larger contact area between the magnetic particles 34 and the photosensitive member 1 to achieve better charging properties. In addition, the magnetic particle control member 33C used is a magnetic control blade or a nonmagnetic control blade to which a magnetic plate is bonded. The positions of poles of the control blade 33C and a magnet 32 contained in the charging sleeve 312 may be adjusted so that the amount of magnetic particles carried can be further stabilized by a combination of mechanical and magnetic control forces.

As in the first embodiment, additionally, the ends of the charging sleeve 312 are insulated by resin coating so that the width of the uninsulated region is larger than the image assurance width and is smaller than the magnetic particle carrying width. The resin coating has a thickness of about 50 μm.

COMPARATIVE EXAMPLE 3-1

Figure 19:
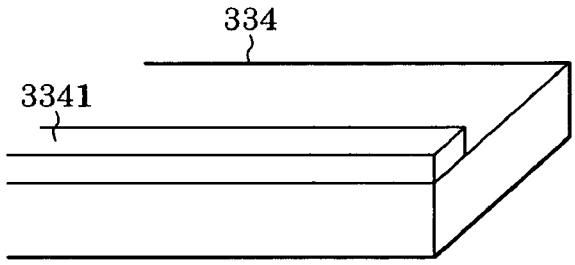
FIG. 19 is a schematic diagram of a control blade used in Comparative Example 3-1.

Comparative Example 3-1 is described below as a specific comparative example for the third embodiment. In this example, the magnetic particle control member 33C used was a control blade 334 shown in FIG. 19. This control blade 334 included a nonmagnetic plate and a magnetic plate 3341 bonded thereto. The magnetic plate 3341 had the same width as the nonmagnetic plate and a thickness of 500 μm.

Under the above conditions, an idling durability test equivalent to 10,000 copies of A4 sheets was carried out to measure the amount of magnetic particles adhering to the photosensitive member 1 at the ends of the charging sleeve 312. The measured amount was about 3.9 g.

EXAMPLE 3-1

Figure 20:
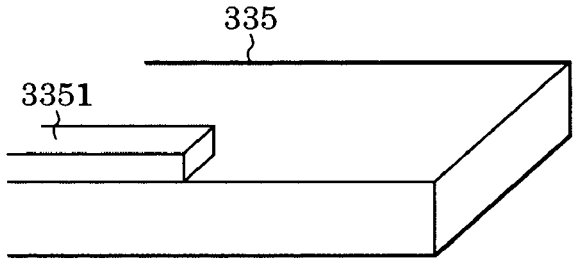
FIG. 20 is a schematic diagram of a control blade used in Example 3-1.

Example 3-1 is described below as a specific example of the third embodiment. FIG. 20 is a schematic diagram of a control blade 335 used to increase the amount of magnetic particles carried at the ends of the magnetic particle carrying region of the charging sleeve 312. This control blade 335 included a bonded nonmagnetic plate 3351 having a longitudinal width different from that of the magnetic plate 3341 used in Comparative Example 3-1. The magnetic plate 3351 had a longitudinal width larger than the injection charging width and smaller than the magnetic particle carrying width. The magnetic plate 3351 was cut in the end regions of the control blade 335 in the longitudinal direction to cover only the central region of the control blade 335, and thus did not cover the end regions. The magnetic force for controlling the magnetic particles 34 was therefore weaker in the end regions than in the central region.

The above control blade 335 was visually confirmed to increase the amount of magnetic particles carried at the ends of the magnetic particle carrying region of the charging sleeve 312 and stabilize the magnetic particle carrying state. Subsequently, the same test as in Comparative Example 3-1 was carried out. The measured amount of magnetic particles adhering to the photosensitive member 1 at the ends of the charging sleeve 312 was about 0.3 g.

According to the above results, even if the amount of magnetic particles carried in the central region of the charging sleeve 312 in the longitudinal direction is relatively small, namely about 50 mg/cm$^2$, the amount of magnetic particles adhering to the photosensitive member 1 at the ends of the charging sleeve 312 may be reduced by increasing the amount of magnetic particles carried in the end regions of the charging sleeve 312 to stabilize the magnetic particle carrying state.

As described above, a magnetic brush charging device charges a photosensitive member by sliding magnetic particles thereon. The amount of magnetic particles carried at the ends of a magnetic particle carrying region of a magnetic particle carrying member may be increased by, for example, modifying a magnetic particle control member to stabilize the magnetic particle carrying state. Such a stable state can inhibit the magnetic particles from adhering to the photosensitive member at the ends of the magnetic particle carrying region of the magnetic particle carrying member. This allows long-term stable operation.

The amount of magnetic particles carried may be increased in the regions outside the image assurance width in the longitudinal direction in consideration of the wear of the photosensitive member. In addition, the optimum method for modifying the magnetic particle control member and the optimum dimensions thereof may be selected according to the design of the charging device.

Photosensitive members have been described as an example of a member to be charged in the above embodiments, though the member to be charged may have no photosensitivity. In addition, the amount of magnetic particles carried at the ends of a charging sleeve is increased by modifying a control blade in the above embodiments, though the present invention is not limited to such methods. For example, the amount of magnetic particles carried at the ends of the charging sleeve may be increased by enhancing the magnetic force of a magnet contained in the charging sleeve only at the ends thereof.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-165915 filed Jun. 3, 2004, which is hereby incorporated by reference herein.

What is claimed is:

1. A charging device for charging a member to be charged, comprising:

magnetic particles;

a magnetic particle carrying member that magnetically carries the magnetic particles into contact with the member to be charged, the magnetic particle carrying member having end regions in a longitudinal direction and a central region in the longitudinal direction; and a magnetic particle adjusting unit configured to adjust an amount per unit area of magnetic particles carried on the magnetic particle carrying member so that the amount per unit area of magnetic particles is larger in the end regions than in the central region, wherein the end regions of the magnetic particle carrying member are regions outside of a region of the member to be charged where an electrostatic latent image is formed in the longitudinal direction, and wherein the central region of the magnetic particle carrying member is a region inside the region of the member to be charged where the electrostatic latent image is formed in the longitudinal direction.

2. The charging device according to claim 1, wherein the magnetic particle adjusting unit includes a magnetic particle control member that controls the amount of magnetic particles carried on the magnetic particle carrying member, and wherein a distance between the magnetic particle control member and the magnetic particle carrying member is larger in the end regions of the magnetic particle carrying member than in the central region of the magnetic particle carrying member.

3. The charging device according to claim 1, wherein the magnetic particle adjusting unit includes:

a magnetic particle control member that controls the amount of magnetic particles carried on the magnetic particle carrying member; and a magnetic member provided on the magnetic particle control member to generate a magnetic force in order to control the magnetic particles, the magnetic force being weaker in the end regions of the magnetic particle carrying member than in the central region of the magnetic particle carrying member.

4. The charging device according to claim 1, wherein the amount per unit area (mg/cm$^2$) of magnetic particles carried in the central region of the magnetic particle carrying member in the longitudinal direction (M) and the distance (μm) between the member to be charged and the magnetic particle carrying member in the central region of the magnetic particle carrying member in the longitudinal direction (S) satisfy M≧0.125S.

5. The charging device according to claim 1, wherein the amount per unit area (mg/cm$^2$) of magnetic particles carried in the central region of the magnetic particle carrying member in the longitudinal direction (M) and the distance (μm) between the member to be charged and the magnetic particle carrying member in the central region of the magnetic particle carrying member in the longitudinal direction (S) satisfy M<0.35S.

6. The charging device according to claim 1, wherein the magnetic particle carrying member includes at least first and second magnetic particle carrying members, wherein the first and second magnetic particle carrying members share the magnetic particles, wherein the second magnetic particle carrying member is positioned on an upstream side with respect to the first magnetic particle carrying member in a movement direction of the magnetic particles in the area between the first and second magnetic particle carrying members and the member to be charged, and wherein with respect to the second magnetic particle carrying member, the amount per unit area (mg/cm$^2$) of magnetic particles carried in the central region of the second magnetic particle carrying member in the longitudinal direction (M) and the distance (μm) between the member to be charged and the second magnetic particle carrying member in the central region of the second magnetic particle carrying member in the longitudinal direction (S) satisfy M≧0.125S.

7. The charging device according to claim 1, wherein the magnetic particle carrying member includes at least first and second magnetic particle carrying members, wherein the first and second magnetic particle carrying members share the magnetic particles, wherein the second magnetic particle carrying member is positioned on an upstream side with respect to the first magnetic particle carrying member in a movement direction of the magnetic particles in the area between the first and second magnetic particle carrying members and the member to be charged, and wherein with respect to the second magnetic particle carrying member, the amount per unit area (mg/cm$^2$) of magnetic particles carried in the central region of the second magnetic particle carrying member in the longitudinal direction (M) and the distance (μm) between the member to be charged and the second magnetic particle carrying member in the central region of the second magnetic particle carrying member in the longitudinal direction (S) satisfy M<0.35S.

8. The charging device according to claim 1, wherein the member to be charged includes an amorphous-silicon-based photosensitive member.

9. The charging device according to claim 1, wherein the member to be charged includes a photosensitive layer and an electron injection layer disposed thereon.

10. The charging device according to claim 1, wherein the magnetic particle carrying member rotates in a direction opposite to a rotational direction of the member to be charged in the area between the magnetic particle carrying member and the member to be charged.

* * * * *